US011701760B2

(12) United States Patent
Ji et al.

(10) Patent No.: US 11,701,760 B2
(45) Date of Patent: Jul. 18, 2023

(54) ELECTRIC TOOL

(71) Applicant: Nanjing Chervon Industry Co., Ltd., Nanjing (CN)

(72) Inventors: Guangjie Ji, Nanjing (CN); Hongtao Ke, Nanjing (CN)

(73) Assignee: Nanjing Chervon Industry Co., Ltd., Nanjing (CN)

( * ) Notice: Subject to any disclaimer, the term of this patent is extended or adjusted under 35 U.S.C. 154(b) by 34 days.

(21) Appl. No.: 17/342,658

(22) Filed: Jun. 9, 2021

(65) Prior Publication Data

US 2021/0387315 A1 Dec. 16, 2021

(30) Foreign Application Priority Data

Jun. 12, 2020 (CN) ..... 202010532564.5
Jun. 12, 2020 (CN) ..... 202010532645.5

(51) Int. Cl.
*B25B 23/00* (2006.01)
*B25B 21/00* (2006.01)

(52) U.S. Cl.
CPC ..... *B25B 23/0035* (2013.01); *B25B 21/00* (2013.01)

(58) Field of Classification Search
CPC . B25B 13/44; B25B 23/0007; B25B 23/0014; B25B 23/0042; B25B 23/0035; B25B 21/00; B25B 31/06; B25B 31/003; B25B 21/02; B25B 23/10; Y10T 279/3481; B25D 17/08; B25F 5/00
USPC ..... 81/54, 185.2, 57.36; 173/213, 217, 48; 279/142
See application file for complete search history.

(56) References Cited

U.S. PATENT DOCUMENTS 7,832,310 B2 * 11/2010 Junkers ..... B25B 21/00 81/52
9,364,942 B2 * 6/2016 Puzio ..... B25B 23/0035
2016/0031068 A1 * 2/2016 Ma ..... B25B 23/10 81/57.36
2018/0354104 A1 * 12/2018 Su ..... B25B 23/0035

* cited by examiner

*Primary Examiner* — Don M Anderson
*Assistant Examiner* — Jason Khalil Hawkins
(74) *Attorney, Agent, or Firm* — Greenberg Traurig, LLP

(57) ABSTRACT

An electric tool includes a tool body and a clamping device configured to clamp an operating attachment. The clamping device includes a moving member, a biasing member, a limiting member, and a switching mechanism. The moving member is sleeved on the output assembly and has a locking position where the operating attachment is locked. The biasing member is configured to apply a biasing force to the moving member to keep the moving member in the locking position. The switching mechanism includes a toggle portion and a driven portion. The toggle portion is configured to be movable toward the tool body and drive the moving member to move in a direction away from the tool body to disengage from the locking position. The biasing member is configured to apply a biasing force to the driven portion to keep the moving member in the locking position.

19 Claims, 9 Drawing Sheets

ELECTRIC TOOL

RELATED APPLICATION INFORMATION

This application claims the benefit under 35 U.S.C. § 119(a) of Chinese Patent Application No. CN 202010532564.5, filed on Jun. 12, 2020, and Chinese Patent Application No. CN 202010532645.5, filed on Jun. 12, 2020, which are incorporated by reference in their entirety herein.

BACKGROUND

A hand-held electric tool is typically equipped with a variety of replaceable working heads. Since the working head needs to be disassembled and replaced frequently, the tool is typically provided with a clamping device for clamping and disassembling the working head. An auxiliary tool is required for a traditional electric tool chuck to implement clamping or opening to replace the working head.

In order to improve the convenience for replacing the working head and simplify operations of clamping and unlocking, an electric tool which is convenient for a user to operate the clamping device with one hand has emerged in the existing art. In the clamping device art, a clamping device, including a push button that moves back and forth along an axial direction of an output shaft, is adopted to implement locking and opening of an attachment by the chuck. However, an existing push button structure moves toward a tool body along the axial direction of the output shaft to implement unlocking of the attachment by the chuck, that is, a finger of a user presses the push button toward a side of the tool body and the push button drives a locking mechanism to move toward an inner side of the output shaft to implement the unlocking by the chuck. Therefore, a part of space needs to be reserved in an interior of the clamping device along the inner side of the axial direction of the output shaft for the locking mechanism to move back for unlocking. As a result, an axial size of the clamping device is relatively large, which is not conducive to the miniaturization of the clamping device and the compactness of the whole machine structure.

SUMMARY

An electric screwdriver includes: a tool body including an output assembly, wherein the output assembly is provided with a cavity allowing an end portion of an operating attachment to enter; and a clamping device configured to clamp the operating attachment. The clamping device includes: a moving member sleeved on the output assembly and having a locking position where the operating attachment is locked; a biasing member and a limiting member, wherein the biasing member is disposed between the moving member and the limiting member, and the biasing member is configured to apply a biasing force to the moving member to keep the moving member in the locking position; and a switching mechanism including a toggle portion and a driven portion. The toggle portion is configured to be movable toward the tool body and drive the moving member to move in a direction away from the tool body to disengage from the locking position, and the biasing member is configured to apply a biasing force to the driven portion to keep the moving member in the locking position.

In one example, the tool body includes a tool housing, the switching mechanism is pivotally connected to the tool housing, and the moving member is disposed on a turning path of the driven portion.

In one example, the driven portion includes two end arms and an opening formed between the two end arms, and the moving member is disposed in the opening.

In one example, an outer periphery of the moving member is provided with a flange cooperating with the driven portion, and the two end arms engage at an axial rear end of the flange.

In one example, the driven portion and the toggle portion are integrally formed.

In one example, the limiting member is provided with a torque-transfer portion, and the limiting member is configured to rotate synchronously with the output assembly through the torque-transfer portion.

In one example, the output assembly includes an outer circumferential surface, the limiting member is an annular member sleeved on the output assembly, the annular member includes an inner ring cooperating with the outer circumferential surface, and the torque-transfer portion includes a non-circular portion disposed on the inner ring.

In one example, the electric screwdriver further includes a switching switch, the switching switch is configured to drive the toggle portion to rotate when operated by a user, and the switching switch is disposed at a front portion of the tool body.

In one example, the tool body is further formed with a hollow sliding groove, and the switching switch is configured to slide in the sliding groove along a direction of a first straight line.

In one example, the electric screwdriver further includes a trigger configured to control startup of the electric tool, a distance between the switching switch and the trigger is greater than or equal to 16 mm and less than or equal to 20 mm along the direction of the first straight line.

In one example, the switching mechanism is pivotally connected to the tool body about a first axis through a pivot shaft, and the first axis is perpendicular to the first straight line.

In one example, the switching mechanism is pivotally connected to the tool body about a first axis through a pivot shaft, and the pivot shaft is arranged on a lower side of the output assembly.

An electric tool includes: a tool body including an output assembly, wherein the output assembly is provided with a cavity allowing an end portion of an operating attachment to enter; and a clamping device configured to clamp the operating attachment. The clamping device includes: a moving member sleeved on the output assembly and having a locking position where the operating attachment is locked; a biasing member and a limiting member, wherein the biasing member is disposed between the moving member and the limiting member, and the biasing member is configured to apply a biasing force to the moving member to keep the moving member in the locking position; and a switching mechanism capable of driving the moving member to disengage from the locking position. The biasing member is configured to apply a biasing force to the switching mechanism to keep the moving member in the locking position.

In one example, the tool body includes a tool housing, the switching mechanism is pivotally connected to the tool housing, and the moving member is disposed on a turning path of the driven portion.

In one example, the switching mechanism further include a toggle portion and a driven portion, the toggle portion is configured to be movable toward the tool body so as to enable the driven portion to drive the moving member to move in a direction away from the tool body to disengage from the locking position.

In one example, the driven portion and the toggle portion are integrally formed.

In one example, the electric tool further includes a switching switch, the switching switch is configured to drive the switching mechanism to rotate when operated by a user, and the switching switch is disposed at a front portion of the tool body.

In one example, the tool body is further formed with a hollow sliding groove, and the switching switch is configured to slide in the sliding groove along a direction of a first straight line.

In one example, the electric tool further includes a trigger configured to control startup of the electric tool, wherein a distance between the switching switch and the trigger is greater than or equal to 16 mm and less than or equal to 20 mm along the direction of the first straight line.

In one example, the switching mechanism is pivotally connected to the tool body about a first axis through a pivot shaft, and the pivot shaft is arranged on a lower side of the output assembly.

The switching mechanism provided in the examples of the present disclosure is simple in structure and has little influence on the structure of the clamp, thereby avoiding a relatively large structural change in the structure of the clamp. Meanwhile, the toggle portion moves toward the tool body to drive the driven portion to move away from the tool body such that the switching mechanism causes the moving member to disengage from the locking position. Since the driven portion moves toward an outer side of the axis of the output shaft in the unlocking process, an axial space of the clamp is not occupied and an axial size of the clamp can be reduced as much as possible. In this manner, the whole machine structure is more compact, thereby facilitating the miniaturization of the tool. On the other hand, the user can trigger the switching mechanism to implement the locking by pressing the trigger portion, which is convenient to operate. The user can operate with one hand, thereby facilitating the improvement of the user experience.

DETAILED DESCRIPTION

Figure 1:
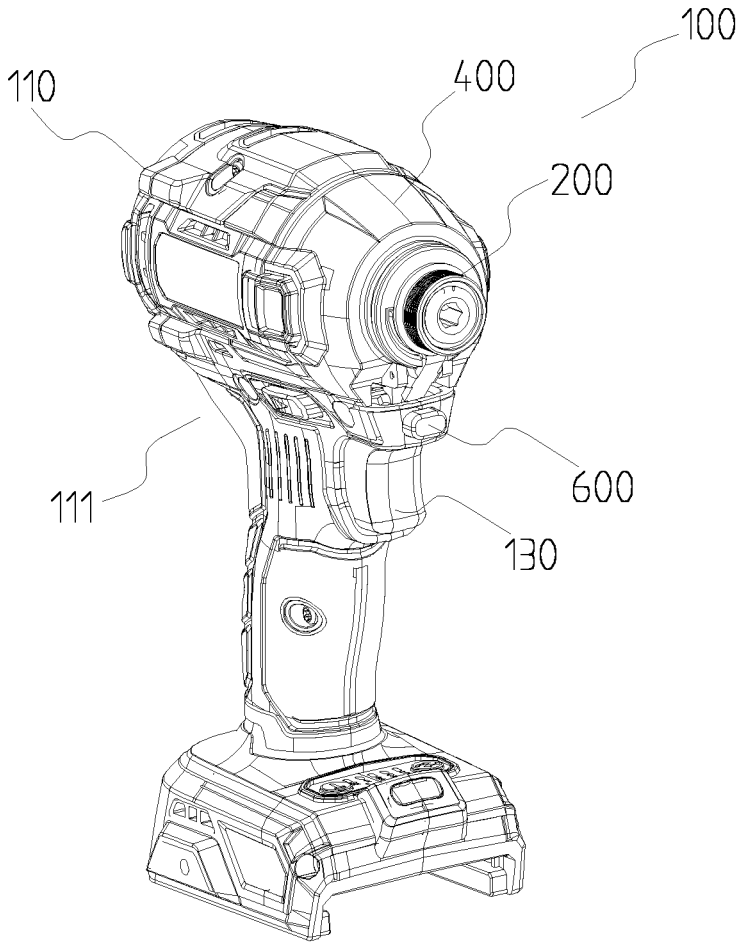
FIG. 1 is a structure view of an electric tool according to the present disclosure.

Referring to FIG. 1, an electric tool 100 is a hand-held electric tool. In the example of the present discourse, the electric tool 100 is an electric screwdriver.

Meanwhile, although this example relates to the hand-held electric tool, it is to be understood that the present disclosure is not limited to the disclosed examples, but may be applied to other types of electric tools including but not limited to other tools such as electric drills that need to clamp an operating attachment.

Figure 5:
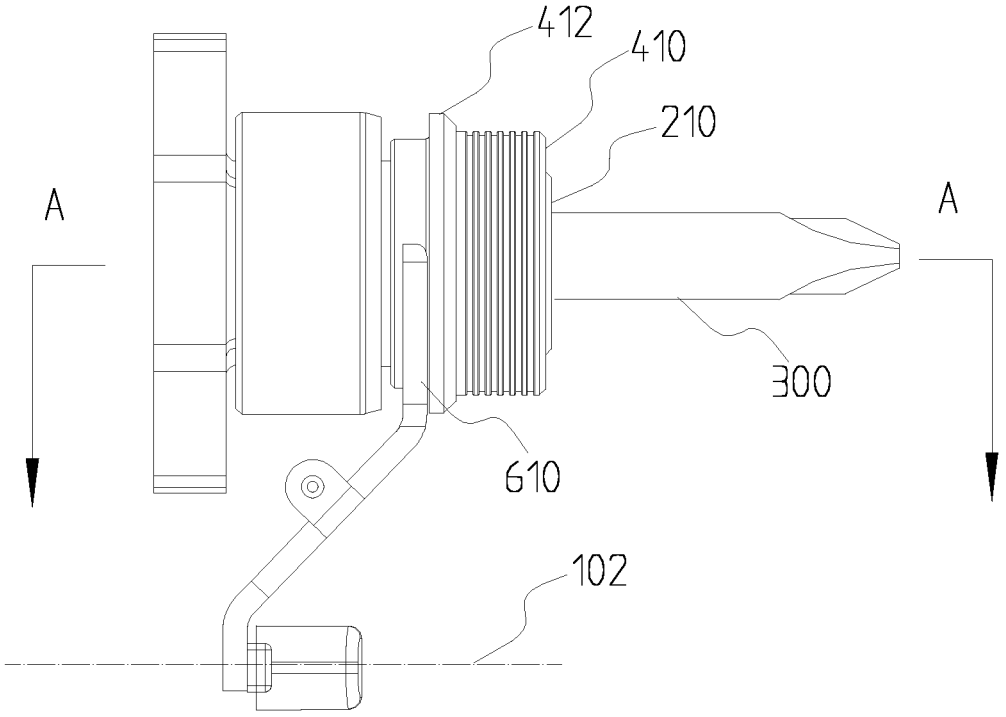
FIG. 5 is a front view of the clamping device shown in FIG. 3.

As shown in FIG. 1, the electric tool 100 includes a tool body 110 and a power supply device. The tool body 110 is provided with a power unit, a control unit, an output assembly 200, and the like. The power unit includes, for example, a motor and a gear box. The control unit includes a control circuit board. The output assembly 200 is connected to the power unit and driven by the power unit. As shown in FIGS. 1 and 5, the output assembly 200 may further be connected to the operating attachment 300 to output power externally. The operating attachment 300 in the example of the present disclosure is a screwdriver head.

The power supply device in the example of the present disclosure is a battery pack (not shown in the figure). The tool body 110 includes a master housing 111 and a clamp housing 450. The battery pack is connected to a leg of the master housing 111 and electrically connected to the control unit and the power unit, and the battery pack supplies power to the power unit. Of course, the electric tool may also be an alternating current tool. In this case, the power supply device includes a plug and a wire connected to commercial power.

Figure 2:
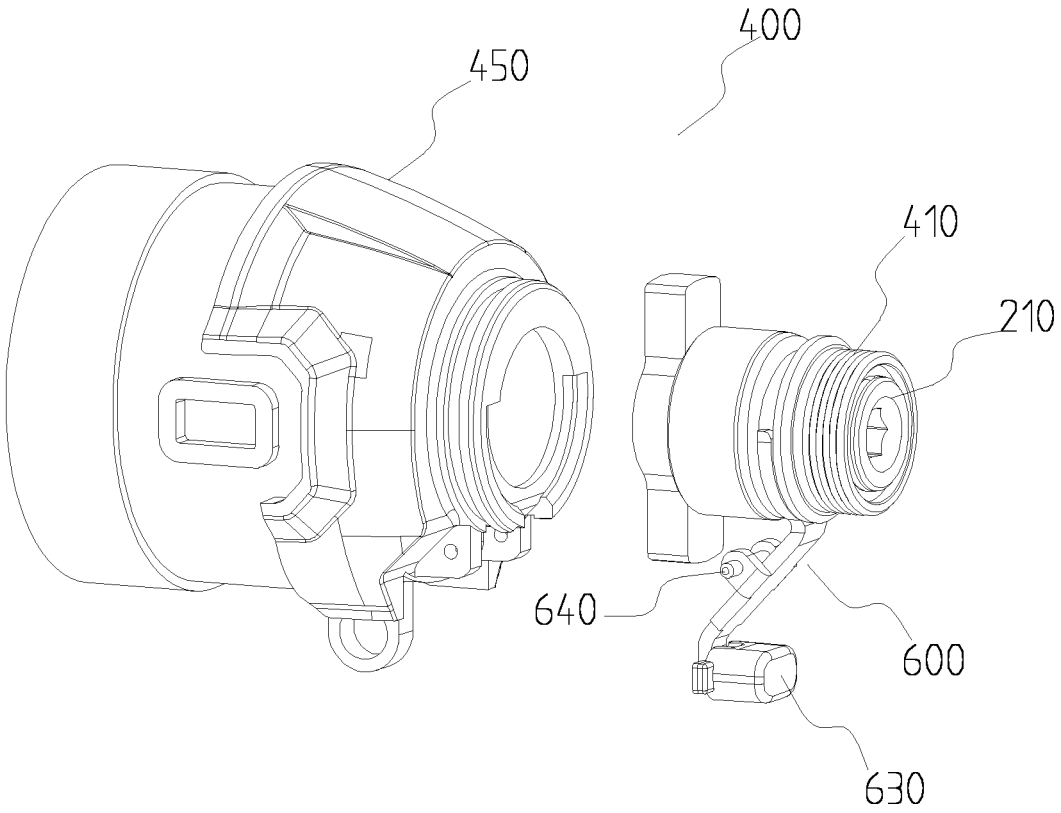
FIG. 2 is a structure view of a clamping device according to the present disclosure.

As shown in FIGS. 1 and 2, the electric tool 100 of the present disclosure further includes a clamping device 400 for clamping and fixing the operating attachment 300. In the example of the present disclosure, the clamping device 400 is specifically a chuck. Referring to FIGS. 1 to 6, the output assembly 200 includes an output shaft 210, the output shaft 210 is provided with a cavity 211 allowing an end portion of the operating attachment 300 to be inserted, and the operating attachment 300 is clamped and fixed by the clamping device 400 after being inserted into the cavity 211.

The clamping device 400 of the present disclosure includes a moving member 410, a biasing member 420, a limiting member 430, an auxiliary limiting member 440, and a clamp housing 450. The clamp housing 450 and the master housing 111 jointly form a tool housing of the electric tool 100.

Figure 6:
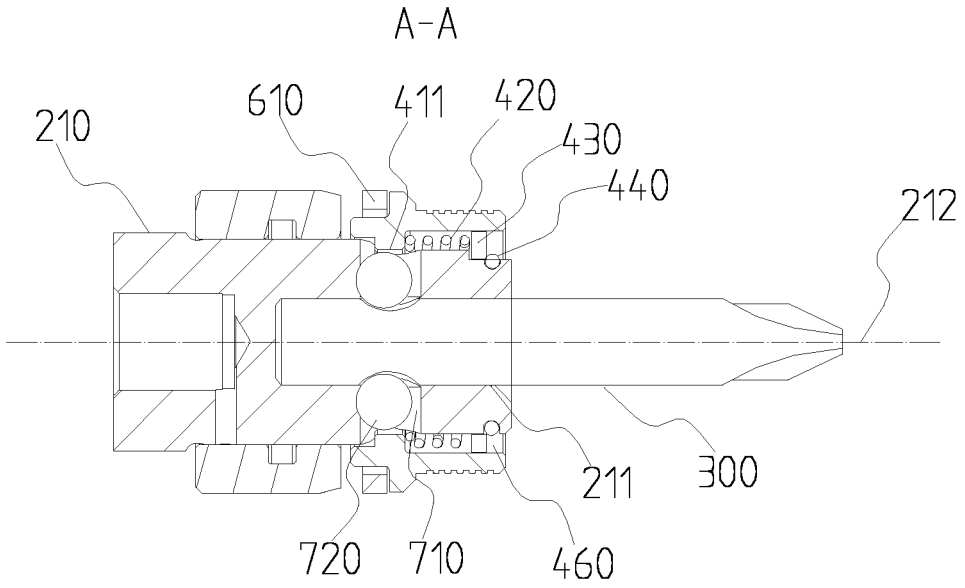
FIG. 6 is a cross-sectional view of the clamping device of FIG. 2 taken along line A-A with a moving member in a locking position.
Figure 7:
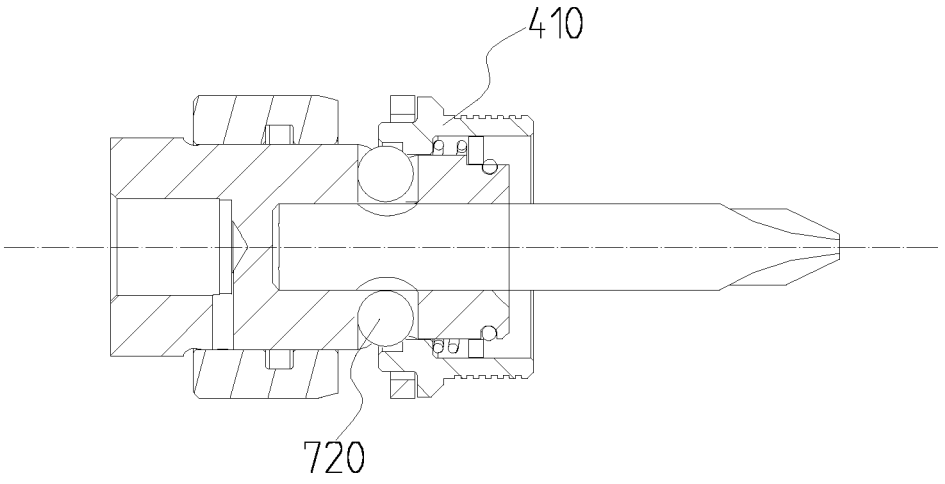
FIG. 7 is a structure view of the clamping device of FIG. 6 when the moving member is disengaged from the locking position

Referring to FIGS. 5 and 6, the moving member 410 is sleeved on the output shaft 210 and has a locking position where the operating attachment 300 is locked, and the moving member 410 can move to disengage from the locking position to release the locking of the operating attachment 300. Specifically, the moving member 410 is a sleeve, the sleeve is sleeved on the output shaft 210 and slidably connected to the output shaft 210, and a mounting cavity 460 for mounting the biasing member 420, the limiting member 430 and the auxiliary limiting member 440 is formed between the sleeve and the output shaft.

Specifically, referring to FIG. 6, an inner side of the sleeve is provided with a clamping jaw 411 protruding toward a radial inner side of the sleeve, the mounting cavity 460 is formed at an axial outer side of the clamping jaw 411, and two ends of the biasing member 420 abut against an axial end face of the clamping jaw 411 and an axial end face of the limiting member 430, respectively.

Figure 3:
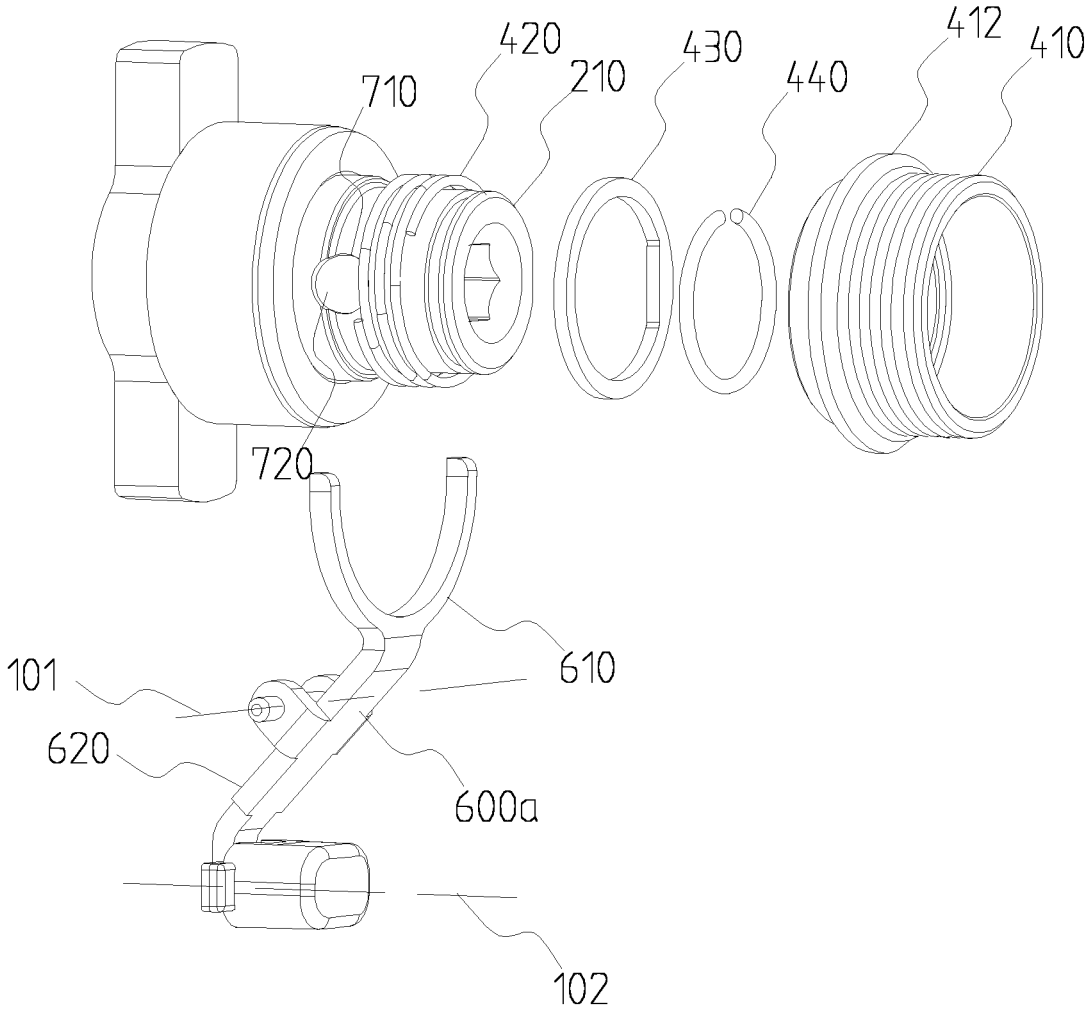
FIG. 3 is an assembly view of the clamping device shown in FIG. 2.

As shown in FIG. 3, the biasing member 420, the limiting member 430, and the auxiliary limiting member 440 are sequentially sleeved on the output shaft 210 from inside to outside, where a side of the output shaft facing toward the operating attachment 300 is an axial outer side, and a side facing toward the tool body is an axial inner side.

The auxiliary limiting member 440 is fixed to the output shaft 210 and rotates synchronously with the output shaft 210. Specifically, the auxiliary limiting member 440 is disposed on the axial outer side of the limiting member 430 and used for axially limiting the limiting member 430. The auxiliary limiting member 440 in this example is a C-shaped ring, an outer periphery of the output shaft 210 is provided with an annular groove, and the C-shaped ring engages and is fixed in the annular groove.

The C-shaped ring that rotates synchronously with the output shaft 210 is provided such that the limiting member 430 is limited and meanwhile the axial friction between the limiting member and the output shaft is avoided due to synchronous rotation of the limiting member with the output shaft 210. Therefore, the abrasion of the limiting member 430 in the using process is further avoided, thereby further prolonging the service life of the chuck.

Of course, the auxiliary limiting member 440 may not be provided and the limiting member 430 is disposed in a groove on the outer periphery of the output shaft 210 so as to achieve the axial limiting of the limiting member 430.

The biasing member 420 is disposed between the moving member 410 and the limiting member 430, and the biasing member 420 is configured to apply a biasing force to the moving member 410 to keep the moving member in the locking position.

Specifically, referring to FIGS. 3 and 6, the biasing member 420 is a spring sleeved on the output shaft 210, and the biasing member 420 is disposed between the moving member 410 and the limiting member 430. Since the limiting member 430 is disposed on the axial outer side of the spring and limited by the auxiliary limiting member 440, an axial outer end of the biasing member 420 is also limited by the limiting member 430, that is, an outer end of the spring in contact with the limiting member 430 is kept in constant displacement, and an inner end of the spring in contact with the moving member 410 is a moving end. In this manner, it can be ensured that the biasing member 420 keeps the moving member 410 in the locking position when the moving member 410 is not subjected to an external force.

Figure 4:
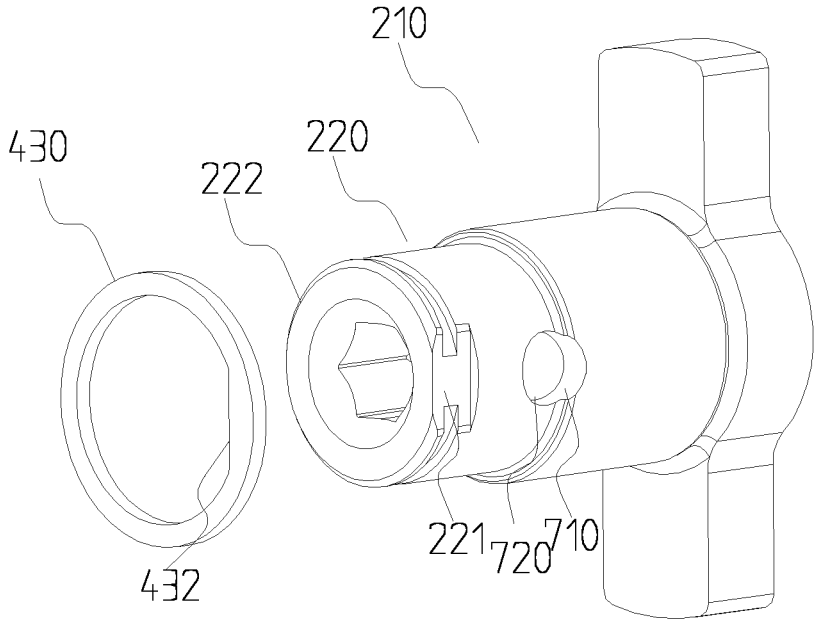
FIG. 4 is a view illustrating that a moving member cooperates with a limiting member according to the present disclosure.
Figure 9:
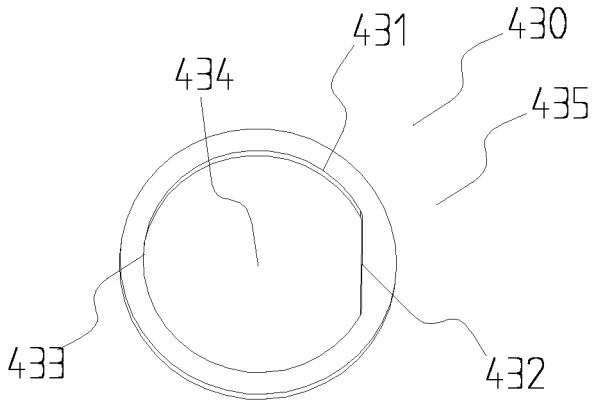
FIG. 9 is a structure view of a limiting member according to the present disclosure.

Referring to FIGS. 4 and 9, the limiting member 430 and the output shaft 210 in this example of the present disclosure are provided with a torque-transfer portion 435 formed through cooperation of the limiting member 430 and the output shaft 210, and the limiting member 430 is configured to rotate synchronously with the output shaft 210 through the torque-transfer portion 435.

As shown in FIG. 4, the output shaft 210 includes an outer circumferential surface 220, and the outer circumferential surface 220 of the output shaft 210 includes a circumferential surface 222 and at least one non-circumferential surface 221.

As shown in FIG. 9, the limiting member 430 is an annular member sleeved on the output shaft 210, and the annular member includes an inner ring 431 cooperating with the outer circumferential surface 220. The inner ring 431 includes an arc portion 433 and at least one non-circular portion 432, and the at least one non-circular portion 432 can cooperate with and be sleeved on the at least one non-circumferential surface 221.

The at least one non-circumferential surface 221 disposed on the outer circumferential surface 220 and the at least one non-circular portion 432 disposed on the inner ring 431 jointly form the torque-transfer portion 435 of the present disclosure. The torque-transfer portion 435 is configured to transfer the rotational torque of the output shaft 210 so that the limiting member 430 is driven to rotate together with the output shaft 210 to avoid relative rotation between the limiting member 430 and the output shaft 210. In this manner, the friction and abrasion between the limiting member 430 and the output shaft 210 can be avoided, and the failure of the limiting member is reduced or even avoided, thereby prolonging the service life of the clamping device. On the other hand, the torque-transfer portion 435 is disposed on the output shaft and the limiting member such that the service life of the clamping device can be prolonged without the need for other structures and parts, thereby avoiding changes in the structure of the whole machine and prolonging the service life of the clamping device without adjusting the internal structure as much as possible.

As shown in FIGS. 4 and 9, the limiting member 430 is a circular ring member having an inner ring 431, the inner ring 431 of the limiting member 430 is provided with a straight line side constituting the non-circular portion 432, and the straight line side protrudes toward a radial inner side of the limiting member 430; and meanwhile the outer circumferential surface 220 of the output shaft 210 is provided with a flat surface constituting the non-circumferential surface 221, and the flat surface is recessed at the outer circumferential surface 220. That is, a distance between a center 434 of the inner ring 431 and the arc portion 433 is greater than a distance between the center 434 of the inner ring 431 and the at least one non-circular portion 432, and a distance between an axis 212 of the output shaft 210 and the circumferential surface 222 is greater than a distance between the axis 212 of the output shaft 210 and the at least one non-circumferential surface 221.

Of course, in an alternative example, the non-circular portion 432 may also be configured to be recessed toward a radial outer side of the limiting member 430, and the non-circumferential surface 221 may be configured to protrude from the outer circumferential surface 220. That is, the distance between the center 434 of the inner ring 431 and the arc portion 433 is less than the distance between the center 434 of the inner ring 431 and the at least one non-circular portion 432, and the distance between the axis 212 of the output shaft 210 and the circumferential surface 222 is less than the distance between the axis 212 of the output shaft 210 and the at least one non-circumferential surface 221.

Of course, in an alternative example, the non-circular portion may also be other irregular sides and not limited to the straight line side, and similarly, the non-circumferential surface may also be other irregular surfaces and not limited to the flat surface so long as the distance between the center of the inner ring and the at least one non-circular portion is different from the distance between the center of the inner ring and the arc portion and the distance between the axis of the output shaft and the at least one non-circumferential surface is different from the distance between the axis and the circumferential surface.

The output shaft 210 of the present disclosure is further provided with a locking channel 710 and a locking member 720. The locking member 720 is configured to implement the locking of the operating attachment 300 in the cavity 211. The locking channel 710 extends substantially radially and communicates with the outer circumferential surface of the output shaft 210 and the cavity 211. The locking member 720 is floated in the locking channel 710. Floating arrangement refers to that the locking member 720 can move slightly in the locking channel 710 so that the locking member 720 is partially exposed outside the locking channel.

In this example, referring to FIG. 6, the locking channel 710 is a channel radially penetrating through the sleeve, the locking channel 710 is arranged corresponding to the locking position, and the locking member 720 is a steel ball movably arranged in the locking channel 710. When the clamping jaw 411 is in the locking position under the action of the biasing member 420, the clamping jaw 411 of the moving member 410 blocks the locking channel 710. In this case, the clamping jaw 411 limits the steel ball from moving away from a radial outer side of the operating attachment 300, and the steel ball protrudes from the inner side of the locking channel 710 due to the limitation of the clamping jaw so that the steel ball engages in a corresponding groove on the operating attachment 300, thereby implementing the locking of the operating attachment 300.

When the moving member 410 overcomes the force of the biasing member 420 under the action of an external force and disengages from the locking position, the clamping jaw 411 disengages from the outer side of the locking channel 710. In this case, when the operating attachment 300 is inserted into or pulled out of the cavity 211, and since the limitation to the outer end of the steel ball is canceled, the steel ball can move toward the outer side of the locking channel 710 under the action of the operating attachment 300 so that the assembly and disassembly of the operating attachment 300 are allowed.

Figure 8:
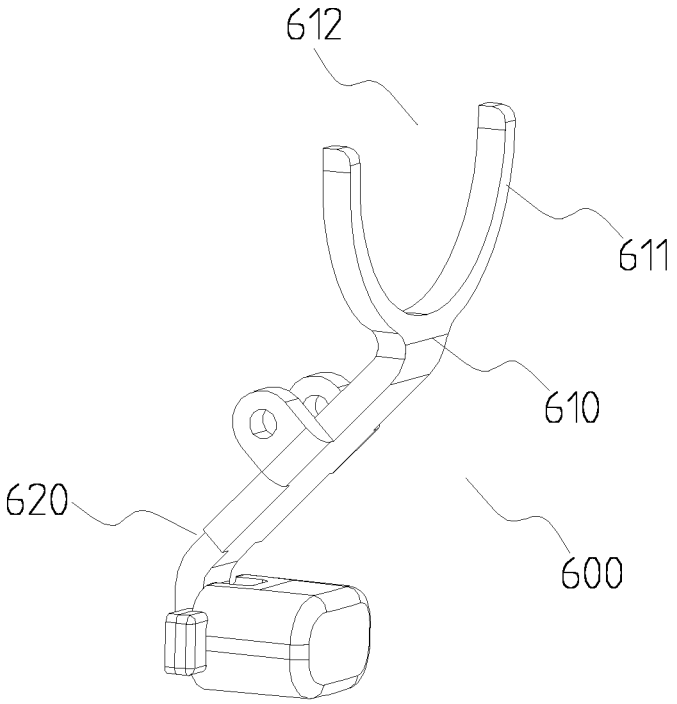
FIG. 8 is a perspective view of a switching member and a switching switch of FIG. 3.

As shown in FIGS. 3, 5 and 8, the electric tool of the present disclosure further includes a switching mechanism 600 for switching the locking or the unlocking of the clamping device. The switching mechanism 600 includes a switching member 600*a*. As shown in FIG. 5, the switching mechanism 600 can drive the moving member 410 to disengage from the locking position, and the biasing member 420 is configured to apply a biasing force to the switching mechanism 600 to keep the switching mechanism 600 in the locking position. The switching member 600*a* of the example of the present disclosure includes a driven portion 610 and a toggle portion 620. The toggle portion 620 is configured to be movable toward the tool body 110 and drive the moving member 410 to move in a direction away from the tool body 110 to disengage from the locking position, and the biasing member 420 is configured to apply a biasing force to the driven portion 610 to keep the switching mechanism 600 in the locking position.

Specifically, as shown in FIG. 2, the switching mechanism 600 is pivotally connected to the clamp housing 450 through a pivot shaft 640, the switching mechanism 600 is rotatable about a first axis 101 of the pivot shaft 640, the pivot shaft 640 is arranged on a lower side of the output assembly 210, and the moving member 410 is disposed at an axial forward side of the toggle portion 620. The moving member 410 is disposed on a turning path of the driven portion 610, the switching mechanism 600 is configured to rotate to drive the moving member 410 to disengage from the locking position, and the biasing member 420 is configured to apply a biasing force to the switching mechanism 600 to keep the switching mechanism 600 in the locking position.

Figure 10:
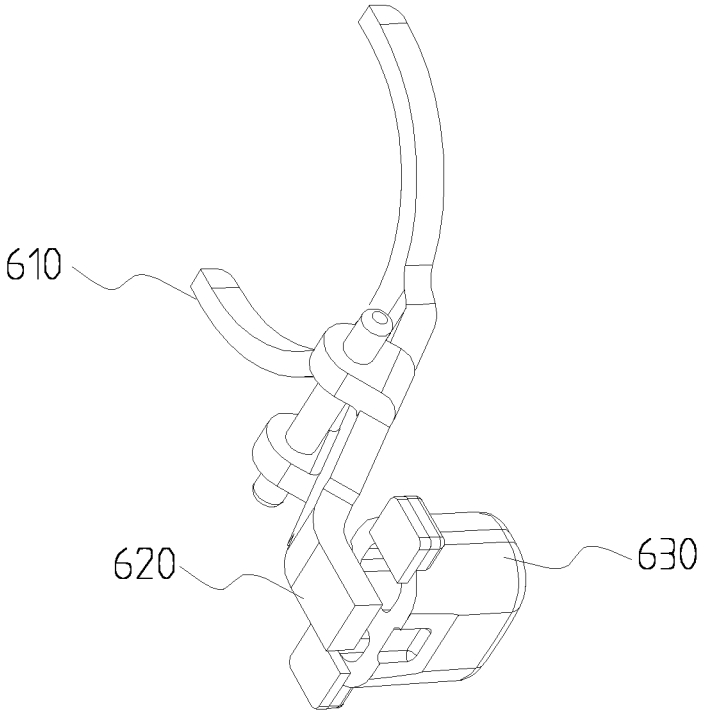
FIG. 10 is another perspective view of the switching member and the switching switch of FIG. 3.

As shown in FIGS. 8 and 10, the switching mechanism 600 has a Y-shaped structure and includes a U-shaped driven portion 610 and a rod-shaped toggle portion 620. The driven portion 610 includes a pair of symmetrically arranged end arms 611, an opening 612 is formed between the end arms 611, and the moving member 410 is suitable for being inserted into the opening 612.

The electric tool 100 further includes a switching switch 630, the switching switch 630 is configured to drive the toggle portion 620 to rotate, the switching switch 630 is disposed at a front portion of the tool body, and the clamping device 400 is disposed at a front end of the electric tool. A user can directly press the switching switch 630 to control the switching mechanism 600 so that the switching mechanism 600 rotates about the pivot shaft, thereby eliminating the need for direct contact with the moving member 410. When the electric tool operates, the moving member 410 disposed at the front end of the electric tool is overheated. The switching mechanism 600 is provided such that the user does not need to be in direct contact with the moving member 410, thereby preventing the user from being scalded. An outer periphery of the moving member 410 is provided with a flange 412 protruding from an outer circumferential surface of the moving member, and the two end arms 611 of the driven portion 610 engage at an axial rear end of the flange 412 and cooperate with the flange 412. Therefore, when the user operates the toggle portion 620 with a finger, the toggle portion 620 moves toward the tool body under the action of an external force, and the switching mechanism 600 rotates about the pivot shaft so that the driven portion 510 is driven to move in a direction away from the tool body to disengage the moving member 410 from the locking position. When the finger of the user is released from the toggle portion 620, the driven portion 610 is driven by the biasing member 420 to drive the toggle portion 620 to return to the locking position.

The tool body 110 is further formed with a hollow sliding groove 112, and the switching switch 630 can slide in the sliding groove 112 along the direction of a first straight line 102. The sliding groove 112 is not provided with an elastic member. The biasing member 420 is configured to drive the moving member 410 back to the locking position, and the moving member 410 is in contact with the driven portion 510 to drive the driven portion to move so that the toggle portion 620 returns to the locking position. When the moving member is in the locking position and the switching switch 630 is not pressed by the user, the switching switch 630 at least partially protrudes relative to the tool body. When the user presses the switching switch 630, the switching switch 630 slides in the sliding groove 112 and drives the toggle portion 620 to move.

The driven portion 610 and the toggle portion 620 are integrally formed to the switching member 600*a*. The switching member 600*a* is rotatable about the first axis 101, the switching switch 630 is sailable along the direction of the first straight line 102, the switching switch 630 and the toggle portion 620 are set separately, and the first axis 101 is perpendicular to the first straight line 102. When the user operates the switching switch 630, the switching switch 630 slides to contact with the toggle portion 620 and drives the toggle portion 620 to rotate about the first axis 101.

Figure 11:
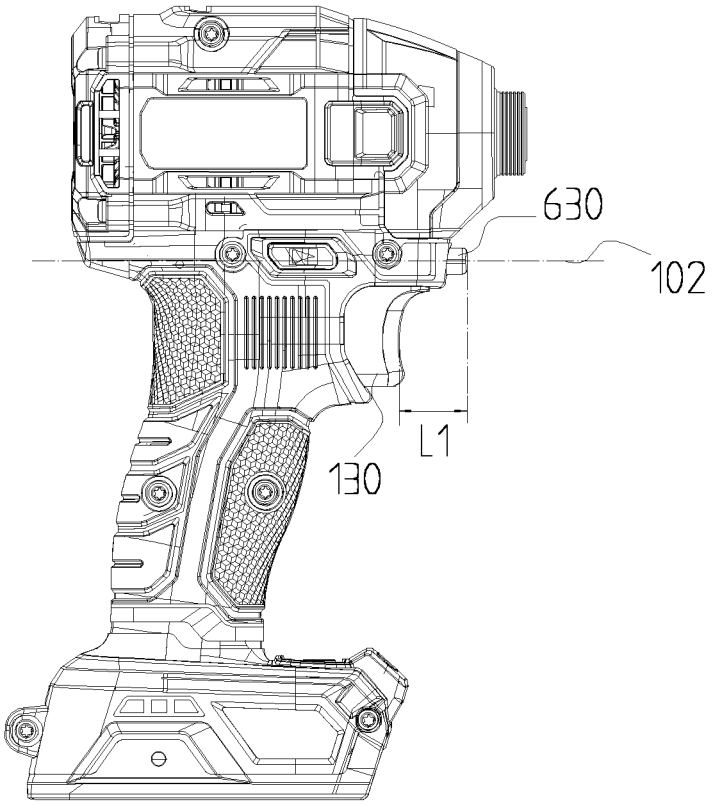
FIG. 11 is a plan view of an electric tool according to the present disclosure.
Figure 12:
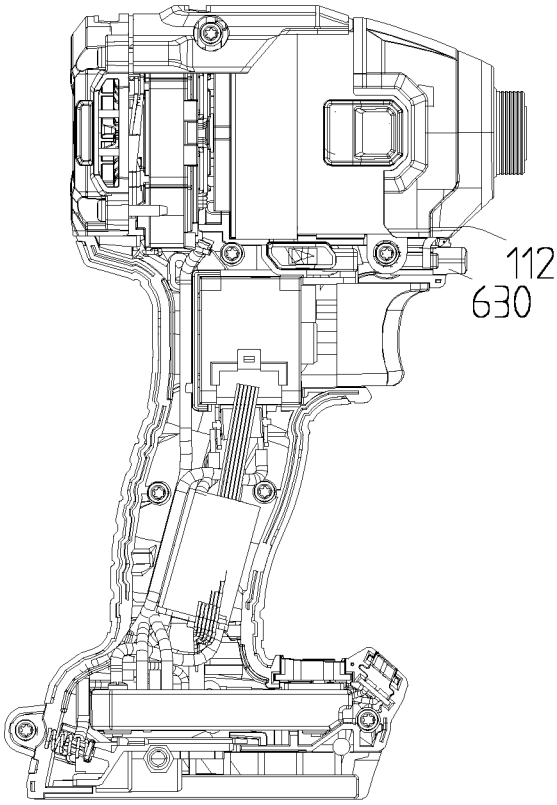
FIG. 12 is an inner structure view of an electric tool according to the present disclosure.

Referring to FIGS. 11 to 12, the electric tool 100 further includes a trigger 130 configured to control startup of the electric tool. Since the sliding groove 112 is hollow, the size of the electric tool can be relatively reduced so that a distance L1 between the switching switch 630 and the trigger is reduced. Along the direction of the first straight line 102, the distance L1 between the switching switch 630 and the trigger is greater than or equal to 16 mm and less than or equal to 20 mm. Here, L1 refers to a distance between an end face of the switching switch 630 for the user to be in contact with and an end face of the trigger 130 for the user to be in contact with. The end faces may be curved surfaces, and L1 may be considered as a distance between two points at the most concave parts of the two end faces. When the user holds with one hand, it is easier to hold and control the switching switch 630 and makes an overall size of the electric tool more compact.

The switching mechanism of the examples of the present disclosure is simple in structure and has little influence on the structure of the clamp, thereby avoiding a relatively large structural change in the structure of the clamp. Meanwhile, the toggle portion moves toward the tool body to drive the driven portion to move away from the tool body such that the switching mechanism causes the moving member to disengage from the locking position. Since the driven portion moves toward an outer side of the axis of the output shaft in the unlocking process, an axial space of the clamp is not occupied and an axial size of the clamp can be reduced as much as possible. In this manner, the whole structure is more compact, thereby facilitating the miniaturization of the tool. On the other hand, the user can trigger the switching mechanism to implement the locking by pressing the trigger portion, which is convenient to operate. The user can operate with one hand, thereby facilitating the improvement of the user experience.

The above illustrates and describes basic principles, main features and advantages of the present disclosure. It is to be understood by those skilled in the art that the above examples do not limit the present disclosure in any form, and solutions obtained by means of equivalent substitution or equivalent transformation fall within the scope of the present disclosure.

What is claimed is:

1. An electric screwdriver, comprising:

a tool body comprising an output assembly having a cavity for receiving an end portion of an operating attachment, wherein the tool body includes a master housing and a clamp housing;

a clamping device comprising a moving member sleeved on the output assembly, a biasing member, and a limiting member wherein the biasing member is disposed between the moving member and the limiting member and the biasing member is configured to apply a biasing force to the moving member to keep the moving member in a locking position in which the operating attachment is locked in the cavity; and a switching mechanism comprising a toggle portion and a driven portion wherein the toggle portion is configured to be movable toward the tool body and to drive the moving member to move in a direction away from the tool body to disengage from the locking position and the biasing member is configured to apply a biasing force to the driven portion to keep the moving member in the locking position, and the switching mechanism is pivotally connected to the clamp housing through a pivot shaft, wherein the limiting member is provided with a torque-transfer portion and the limiting member is configured to rotate synchronously with the output assembly through the torque-transfer portion.

2. The electric screwdriver of claim 1, wherein the moving member is disposed on a turning path of the driven portion.

3. The electric screwdriver of claim 1, wherein the driven portion comprises two end arms and an opening is formed between the two end arms in which the moving member is disposed.

4. The electric screwdriver of claim 3, wherein an outer periphery of the moving member is provided with a flange cooperating with the driven portion and the two end arms engage at an axial rear end of the flange.

5. The electric screwdriver of claim 1, wherein the driven portion and the toggle portion are integrally formed.

6. The electric screwdriver of claim 1, wherein the output assembly comprises an outer circumferential surface, the limiting member is an annular member sleeved on the output assembly, the annular member comprises an inner ring cooperating with the outer circumferential surface, and the torque-transfer portion comprises a non-circular portion disposed on the inner ring.

7. The electric screwdriver of claim 1, wherein the electric screwdriver further comprises a switching switch, the switching switch is configured to drive the toggle portion to rotate when operated by a user, and the switching switch is disposed at a front portion of the tool body.

8. The electric screwdriver of claim 7, wherein the tool body is further formed with a hollow sliding groove and the switching switch is configured to slide in the sliding groove along a direction of a first straight line.

9. The electric screwdriver of claim 8, wherein the electric screwdriver further comprises a trigger configured to control startup of the electric tool and a distance between the switching switch and the trigger is greater than or equal to 16 mm and less than or equal to 20 mm along the direction of the first straight line.

10. The electric screwdriver of claim 8, wherein the switching mechanism is pivotally connected to the tool body about a first axis through the pivot shaft and the first axis is perpendicular to the first straight line.

11. The electric screwdriver of claim 1, wherein the switching mechanism is pivotally connected to the tool body about a first axis through the pivot shaft and the pivot shaft is arranged on a lower side of the output assembly.

12. An electric tool, comprising:

a tool body comprising an output assembly having a cavity for receiving an end portion of an operating attachment;

a clamping device comprising a moving member sleeved on the output assembly, a biasing member, and a limiting member wherein the biasing member is disposed between the moving member and the limiting member and the biasing member is configured to apply a biasing force to the moving member to keep the moving member in a locking position where the operating attachment is locked in the cavity, wherein the limiting member is provided with a torque-transfer portion and the limiting member is configured to rotate synchronously with the output assembly through the torque-transfer portion; and a switching mechanism capable of driving the moving member to disengage from the locking position wherein the biasing member is configured to apply a biasing force to the switching mechanism to keep the moving member in the locking position.

13. The electric tool of claim 12, wherein the tool body comprises a tool housing, the switching mechanism is pivotally connected to the tool housing, and the moving member is disposed on a turning path of the driven portion.

14. The electric tool of claim 12, wherein the switching mechanism further comprise a toggle portion and a driven portion and the toggle portion is configured to be movable toward the tool body so as to enable the driven portion to drive the moving member to move in a direction away from the tool body to disengage from the locking position.

15. The electric tool of claim 14, wherein the driven portion and the toggle portion are integrally formed.

16. The electric tool of claim 12, wherein the electric tool further comprises a switching switch, the switching switch is configured to drive the switching mechanism to rotate when operated by a user, and the switching switch is disposed at a front portion of the tool body.

17. The electric tool of claim 16, wherein the tool body is further formed with a hollow sliding groove and the switching switch is configured to slide in the sliding groove along a direction of a first straight line.

18. The electric tool of claim 17, wherein the electric tool further comprises a trigger configured to control startup of the electric tool and a distance between the switching switch and the trigger is greater than or equal to 16 mm and less than or equal to 20 mm along the direction of the first straight line.

19. The electric tool of claim 12, wherein the switching mechanism is pivotally connected to the tool body about a first axis through a pivot shaft and the pivot shaft is arranged on a lower side of the output assembly.

* * * * *